US005507117A

United States Patent [19]

Kalman et al.

[11] Patent Number: 5,507,117

[45] Date of Patent: Apr. 16, 1996

[54] TREE STAND

[75] Inventors: Jeffrey M. Kalman, Cleveland Heights; John R. Nottingham, Hunting Valley; Jeffrey S. Plantz, Seven Hills; Paul A. Tamulewicz, Parma, all of Ohio

[73] Assignee: County Line Limited Partnership, L.L.C., Warrensville Heights, Ohio

[21] Appl. No.: 69,013

[22] Filed: May 28, 1993

[51] Int. Cl.[6] ..... A47G 7/02

[52] U.S. Cl. ..... 47/40.5; 248/516

[58] Field of Search ..... 248/516, 525, 248/416; 47/40.5

[56] References Cited

U.S. PATENT DOCUMENTS

| | | | |
|---|---|---|---|
| D. 332,582 | 1/1993 | Quinn . | |
| D. 339,549 | 9/1993 | Hermanson . | |
| D. 342,694 | 12/1993 | Frost . | |
| D. 344,250 | 2/1994 | Johnson et al. . | |
| 868,568 | 10/1907 | Jones . | |
| 1,224,607 | 5/1917 | Craven . | |
| 2,587,788 | 3/1952 | Tacy . | |
| 2,905,414 | 9/1959 | Zierden . | |
| 2,933,274 | 4/1960 | Mausolf | 47/40.5 |
| 2,980,377 | 4/1961 | Nielsen et al. . | |
| 2,997,264 | 8/1961 | Zelenitz . | |
| 3,204,898 | 9/1965 | Manning | 248/516 |
| 3,715,095 | 2/1973 | Drablowski . | |
| 3,779,493 | 12/1973 | Gidlof . | |
| 3,901,469 | 8/1975 | Davis et al. . | |
| 4,130,965 | 12/1978 | Patton et al. | 47/40.5 |
| 4,156,323 | 5/1979 | Scheffler | 47/40.5 |
| 4,159,096 | 6/1979 | Chase . | |
| 4,231,539 | 11/1980 | Sandham | 248/415 |
| 4,260,365 | 4/1981 | Kayne . | |
| 4,393,621 | 7/1983 | Rodell | 47/40.5 |
| 4,408,415 | 10/1983 | Davis et al. . | |
| 4,541,601 | 9/1985 | Corbisello | 248/516 |
| 4,571,882 | 2/1986 | Capen | 47/40.5 |
| 4,699,347 | 10/1987 | Kuhnley | 248/516 |
| 5,114,113 | 5/1992 | Krinner | 47/40.5 |
| 5,201,140 | 4/1993 | Voorhis . | |
| 5,209,450 | 5/1993 | Grapes . | |
| 5,236,167 | 8/1993 | Tai . | |
| 5,243,782 | 9/1993 | Jones . | |
| 5,249,772 | 10/1993 | Montie, Jr. et al. . | |
| 5,279,071 | 1/1994 | McDougall . | |
| 5,290,004 | 3/1994 | Frost et al. . | |
| 5,299,381 | 4/1994 | Oldenburg, Jr. . | |
| 5,301,462 | 4/1994 | Hronyetz . | |

FOREIGN PATENT DOCUMENTS

| | | |
|---|---|---|
| 153889 | 3/1991 | Taiwan . |

OTHER PUBLICATIONS

"Perennial Problem: How to Get a Conifer To Stand Straight," by Barbara Marsh, *The Wall Street Journal*, Dec. 11, 1992 (4 pages).

*Primary Examiner*—Terry Lee Melius
*Assistant Examiner*—Joanne C. Downs
*Attorney, Agent, or Firm*—Calfee, Halter & Griswold

[57] ABSTRACT

A Christmas tree stand which comprises a receptacle and a two-piece base is provided. The receptacle is placed over the trunk of a tree and a clamping assembly is used to secure the tree within the receptacle. The receptacle is then inserted into a top portion of the base. The top portion of the base is moveable with respect to a bottom portion of the base. A movement assembly is provided which enables one person to easily move the top portion with respect to the bottom portion. Additionally, the top portion of the base includes a cavity for holding water.

9 Claims, 12 Drawing Sheets

TREE STAND

FIELD OF THE INVENTION

The present invention relates generally to a tree stand for vertically positioning a tree. More particularly, the present invention relates to a Christmas tree stand which may be easily operated by one person to vertically position a Christmas tree.

BACKGROUND OF THE INVENTION

The problem of positioning a Christmas tree within a Christmas tree stand is well known. First, utilizing one piece stands, it is difficult, particularly for one person, to insert a tree into the stand and then secure the tree while it is in an erect position. Depending upon the size of the tree, it usually takes more than one person to lift the tree into the stand, to hold the tree upright, and to secure the tree within the stand. Further, once the tree is secure within the stand, it is difficult to adjust the tree so that it stands straight. Typically, the person straightening the tree has to adjust the tree by manipulating a mechanism on the stand. In order to do this, the person must be bent over in the vicinity of the stand. In this position, it is difficult to see whether the tree is straight. Therefore, to position the tree, the tree must first be adjusted and then viewed to see whether it is straight. Alternatively, another person has to tell the person straightening the tree whether the tree is straight.

A variety of tree stands were developed in an attempt to overcome these difficulties with one piece stands. For example, some two piece stands were developed which permit a first piece of the stand to be secured to the trunk of the tree while the tree is lying on its side. After the first piece has been secured to the trunk of the tree, the tree and the first piece of the stand may be inserted into a second piece of the stand. Further, other stands permit a single person to adjust the tree without having to bend over in the vicinity of the stand.

However, problems still exist with present day Christmas tree stands. The mechanisms which are used to secure the tree within the stand are not always sturdy enough. In addition, the mechanisms which are used to adjust the tree are not always easy to use.

SUMMARY OF THE INVENTION

The present invention provides a Christmas tree stand which permits a Christmas tree to be solidly secured within the stand and to be easily adjusted to a desired vertical position.

More particularly, the present invention provides a Christmas tree stand which comprises a receptacle and a two-piece base. The receptacle is placed over the trunk of a tree and a clamping assembly is used to secure the tree within the receptacle. The receptacle is then inserted into a top portion of the base. The top portion of the base is moveable with respect to a bottom portion of the base. A movement assembly is provided which enables one person to easily move the top portion with respect to the bottom portion. Additionally, the top portion of the base includes a cavity for holding water.

These and other features of the present invention are fully described and particularly pointed out in the claims. The following detailed description and accompanying drawings set forth in detail an illustrative embodiment. However, this embodiment is indicative of but one of the various ways in which the principles of the present invention may be employed.

DETAILED DESCRIPTION OF THE PREFERRED EMBODIMENT

Figure 1:
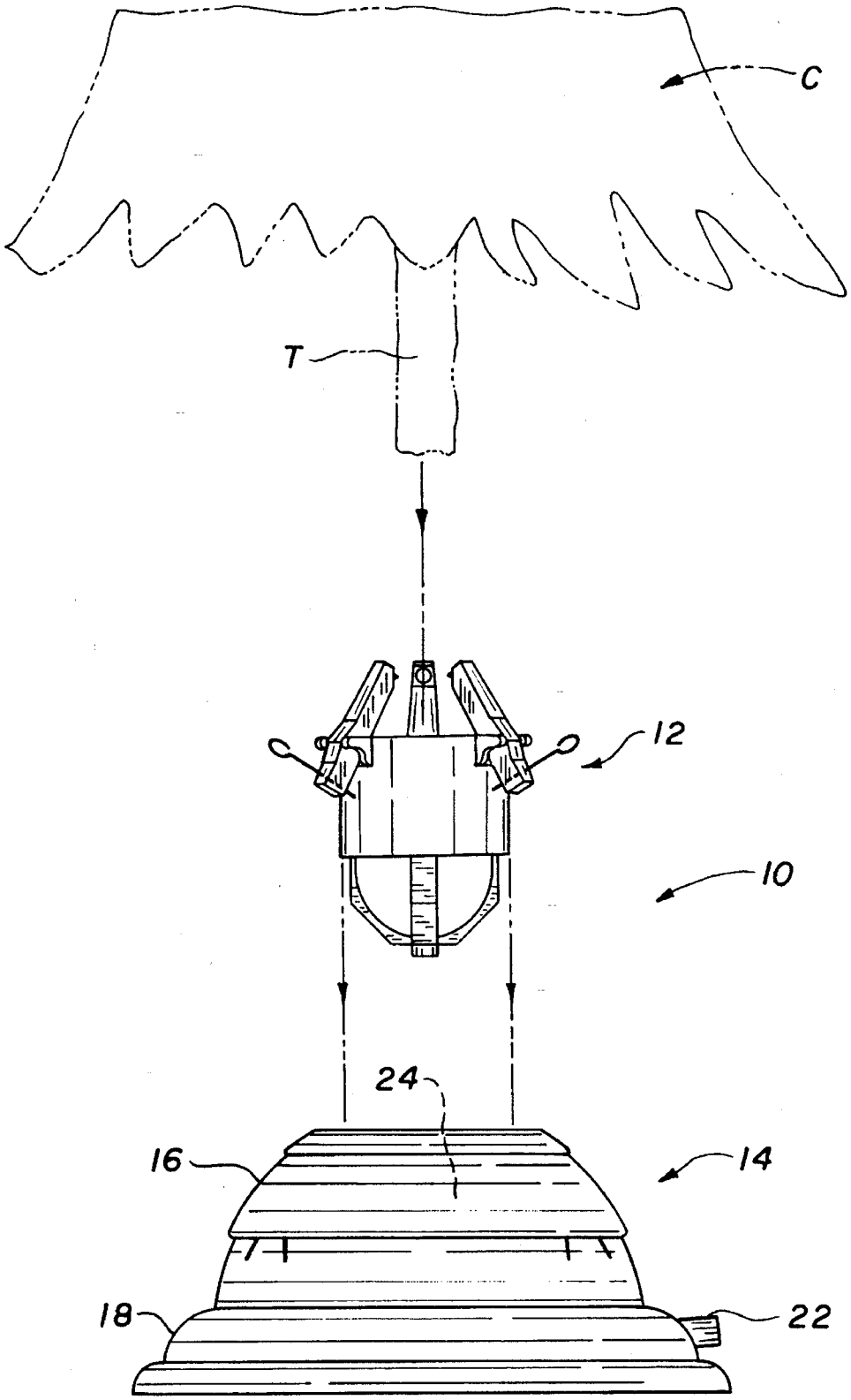
FIG. 1 is an exploded view of the components of a Christmas tree stand constructed according to the principles of the present invention.

Referring to the drawings, FIG. 1 is an exploded view of the components of a Christmas tree stand, indicated generally at reference numeral 10, constructed according to the principles of the present invention. The Christmas tree stand 10 comprises a receptacle 12 and a two-piece base 14. During use of the Christmas tree stand 10, the receptacle 12 is placed over a trunk T of a Christmas tree C. The trunk T is then secured within the receptacle 12. Next, the receptacle 12 is inserted into a top portion 16 of the base 14. The top portion 16 of the base 14 is moveable with respect to a bottom portion 18 of the base 14.

A movement assembly, indicated generally at reference numeral 20 (illustrated in FIGS. 5*a*, 5*b*, 6, 11, and 12), enables the top portion 16 to move with respect to the bottom portion 18. The movement assembly 20 includes a foot pedal 22 which may be moved between a first position and a second position. In the first position (illustrated in solid lines in FIG. 8), the top portion 16 is prevented from moving with respect to the bottom portion 18. In the second position (illustrated in phantom in FIG. 8), the top portion 16 is permitted to move freely with respect to the bottom portion 18. Additionally, the top portion 16 of the base 14 includes a cavity 24 for holding water.

Figure 2:
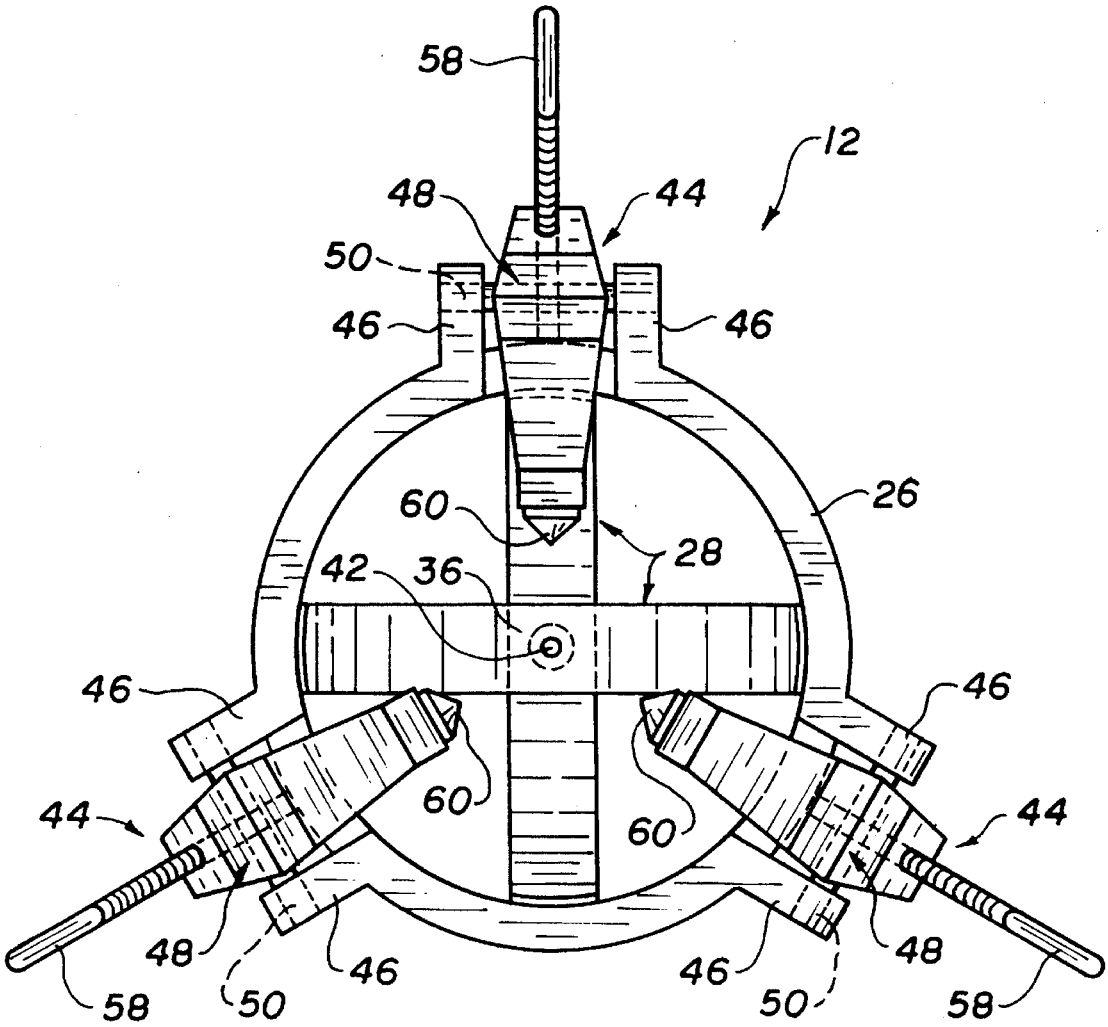
FIG. 2 is a top view of the receptacle of the Christmas tree stand of FIG. 1.
Figure 3:
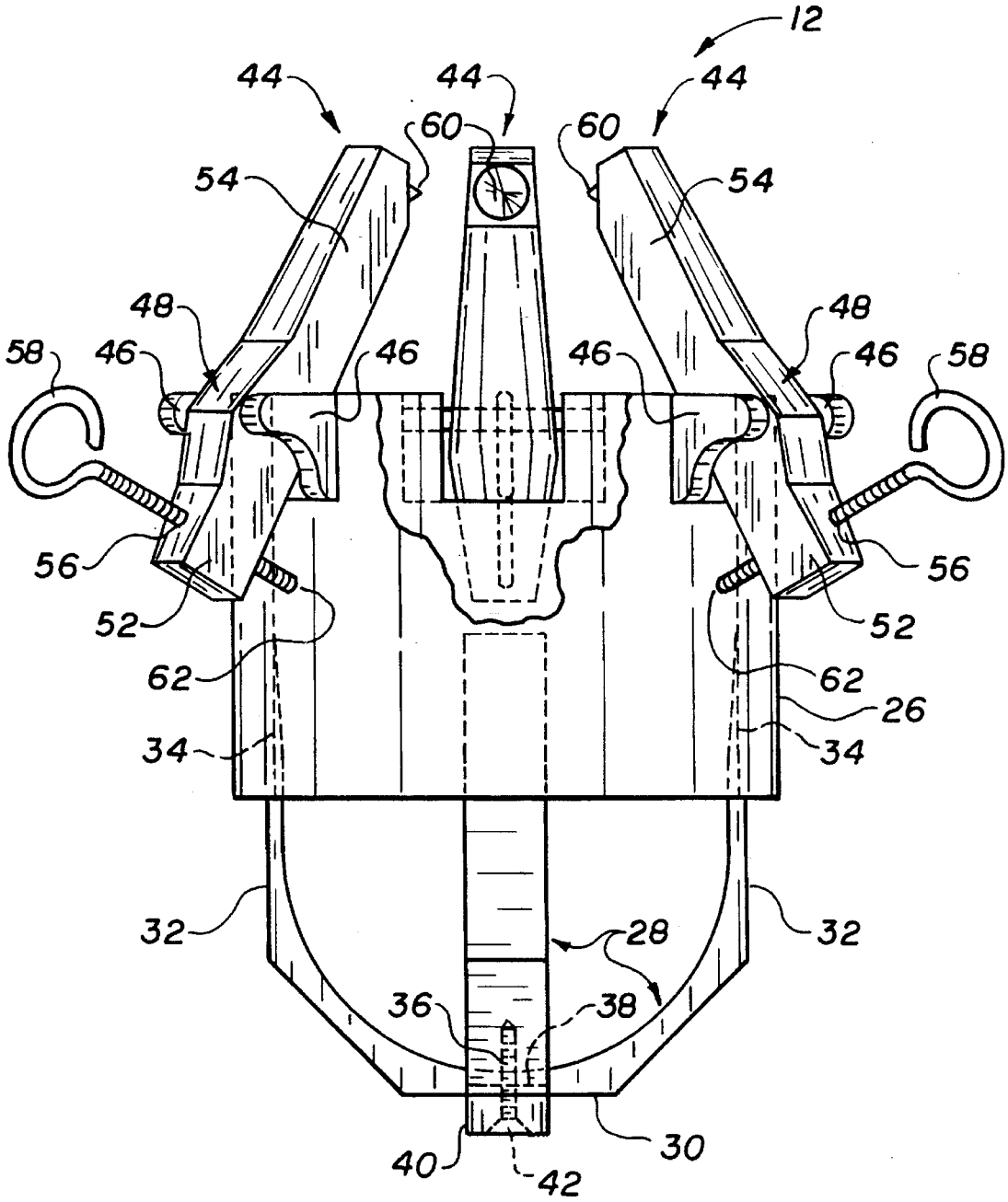
FIG. 3 is a side view of the receptacle of the Christmas tree stand of FIG. 1.

As illustrated in FIGS. 2 and 3, the receptacle 12 receives the trunk T of the Christmas tree C. Receptacle 12 includes an annular sleeve 26 which substantially surrounds the trunk T of the Christmas tree C. U-shaped members 28 are attached to the sleeve 26 and extend downwardly therefrom. Each U-shaped member 28 has a central portion 30 and side portions 32 extending upwardly from the central portion 30. The side portions 32 are attached to an inner lower portion 34 of the sleeve 26. The side portions 32 are circumferentially spaced around the sleeve 26 at approximately 90° intervals. The central portions 30 cross at a central point 36, and one of the central portions 30 has a notch 38 therein for receiving the other central portion 30. In this manner, the U-shaped members 28 support the trunk T of the Christmas tree C. Further, a circular projection 40 extends downwardly at the central point 36, and a fastener or screw 42 extends upwardly at the central point 36 through the circular projection 40 and both of the central portions 30 of the U-shaped members 28. When the receptacle 12 is placed over the trunk T of the Christmas tree C, the screw 42 may be screwed into the trunk T to secure the trunk T within the receptacle 12.

A plurality of arms 44 are attached to the receptacle 12 to further secure the trunk T within the receptacle 12. In the preferred and illustrated embodiment, three arms 44 are provided. The arms 44 are circumferentially spaced around the sleeve 26 at approximately 120° intervals. Each arm 44 is attached to an outer upper portion 46 of the sleeve 26 forming a hinge 48 engaged with the arm 44 via a shaft 50 through the arm 44 positioned between a first end 52 and a second end 54 of the arm 44. The first end 52 has a bore 56 for threadably receiving a screw member 58. The second end 54 has a sharp point 60. When the screw member 58 is rotated within the bore 56, the screw member 58 engages an outer portion 62 of the sleeve 26 and causes the second end 54 of the arm 44 to move inwardly toward the trunk T of the Christmas tree C. As the second end 54 of the arm 44 moves inwardly, the sharp point 60 is driven into engagement with the trunk T and thereby secures the trunk T within the receptacle 12.

Figure 4:
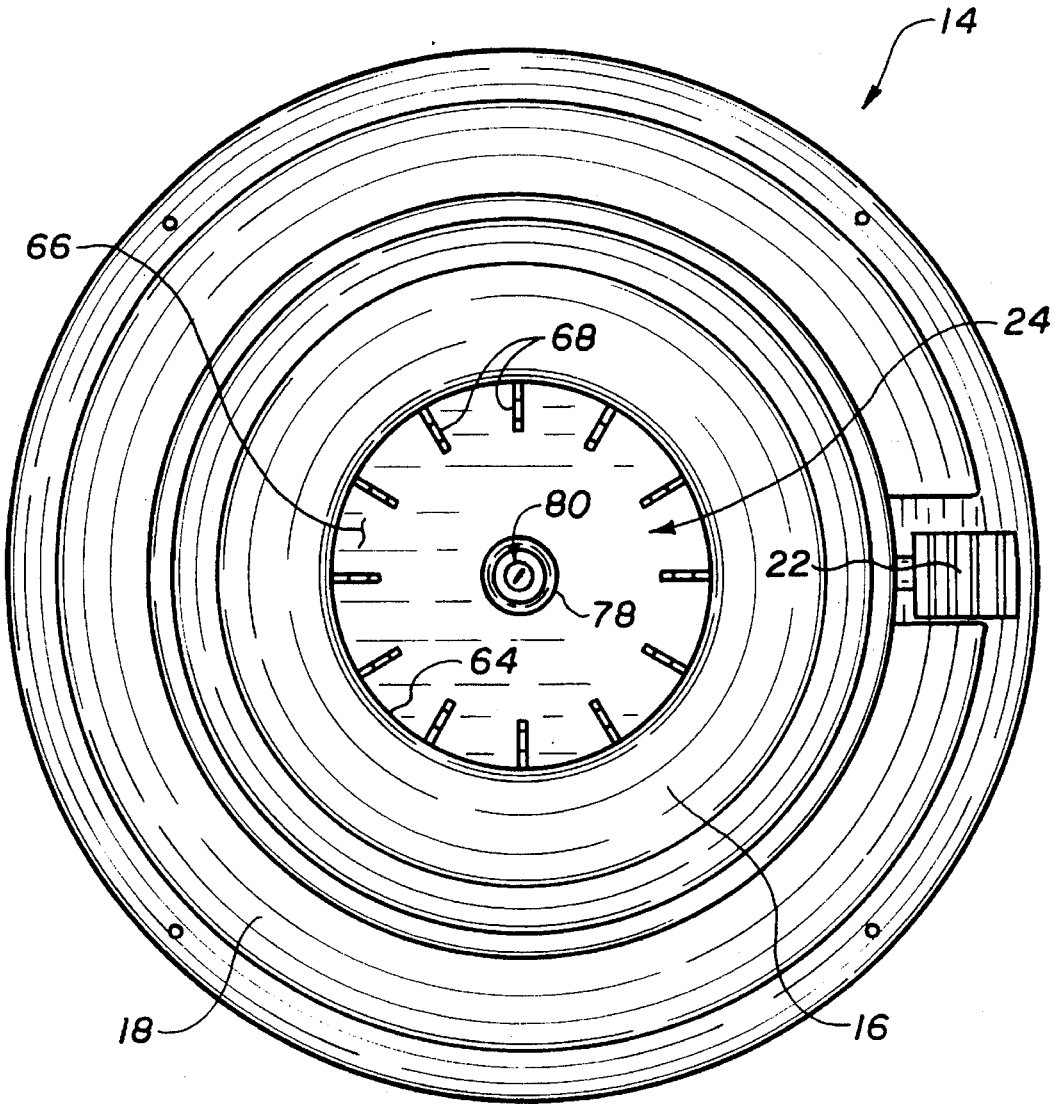
FIG. 4 is a top view of the base of the Christmas tree stand of FIG. 1.

Referring now to FIG. 4, a top view of the base 14 of the Christmas tree stand 10 is illustrated. After the receptacle 12 has been placed over the trunk T of the Christmas tree C and the trunk T has been secured within the receptacle 12, the receptacle 12 is inserted into the cavity 24 in the top portion 16 of the base 14. A receiving wall surface 64 and a receiving floor surface 66 which define the cavity 24 are configured for mating engagement with the receptacle 12. This mating engagement permits the receptacle 12 to be securely positioned within the top portion 16 of the base 14 without the use of additional fasteners.

Figure 5A:
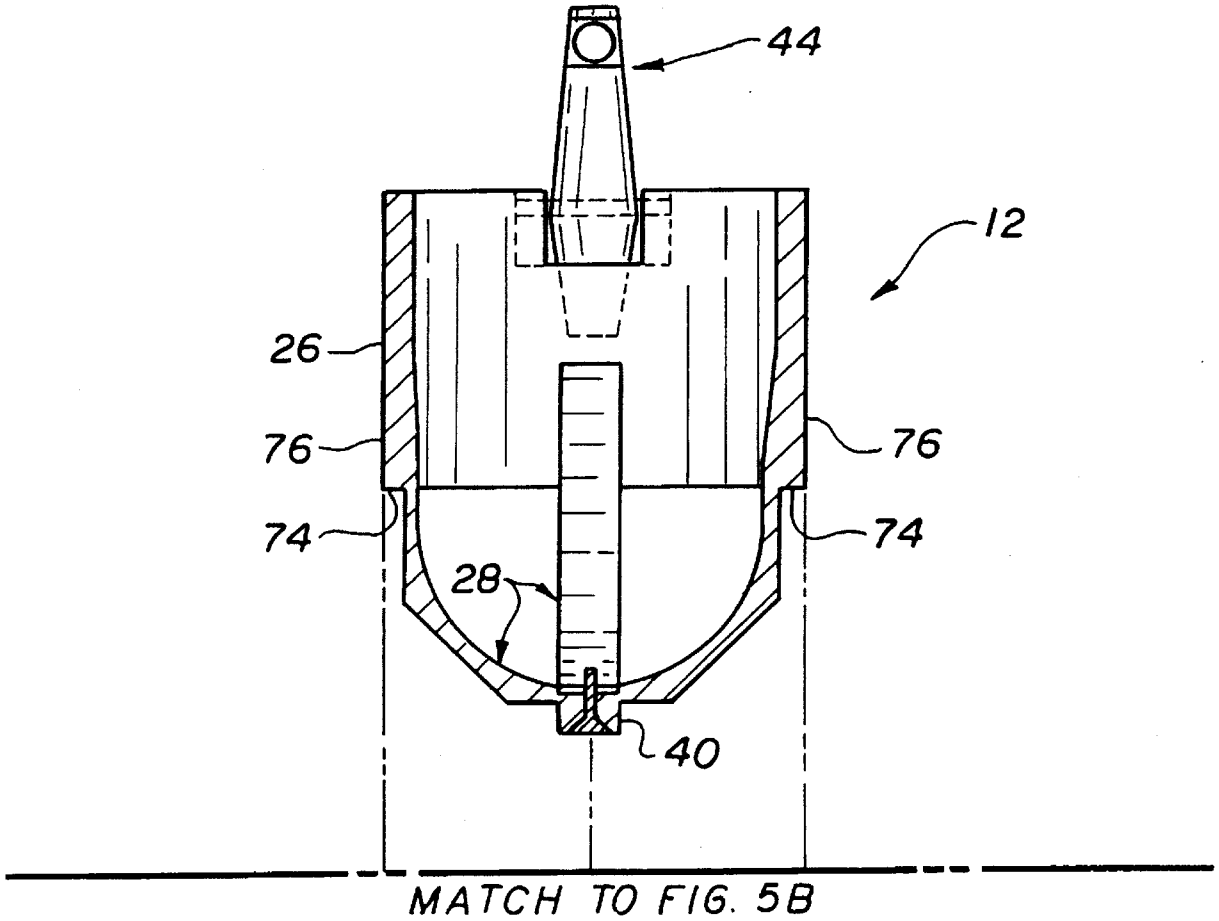
FIGS. 5*a* and 5*b* collectively are an exploded cross-sectional side view of the receptacle in relationship to the base of the Christmas tree stand of FIG. 1.
Figure 5B:
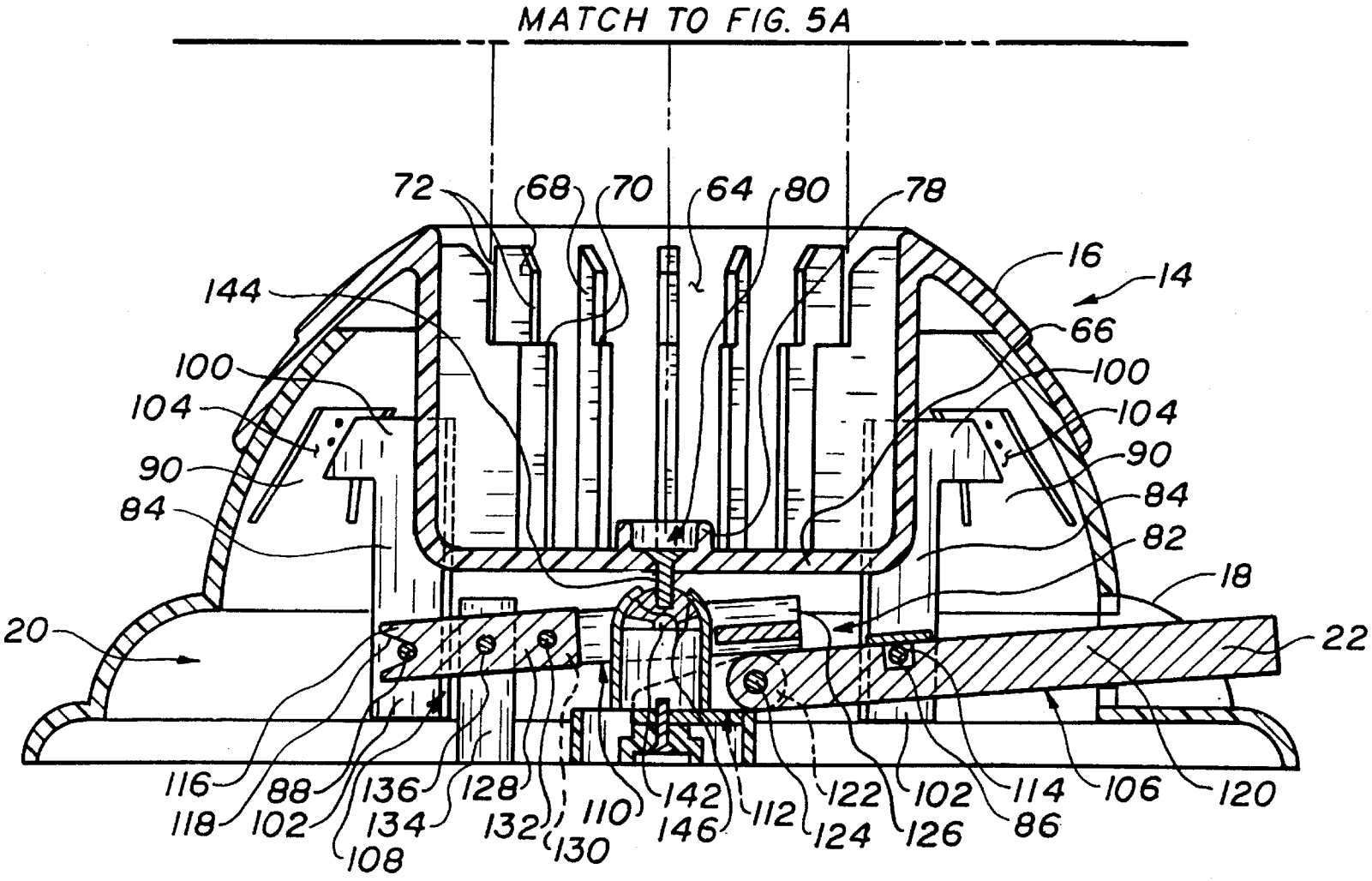
Figure 6:
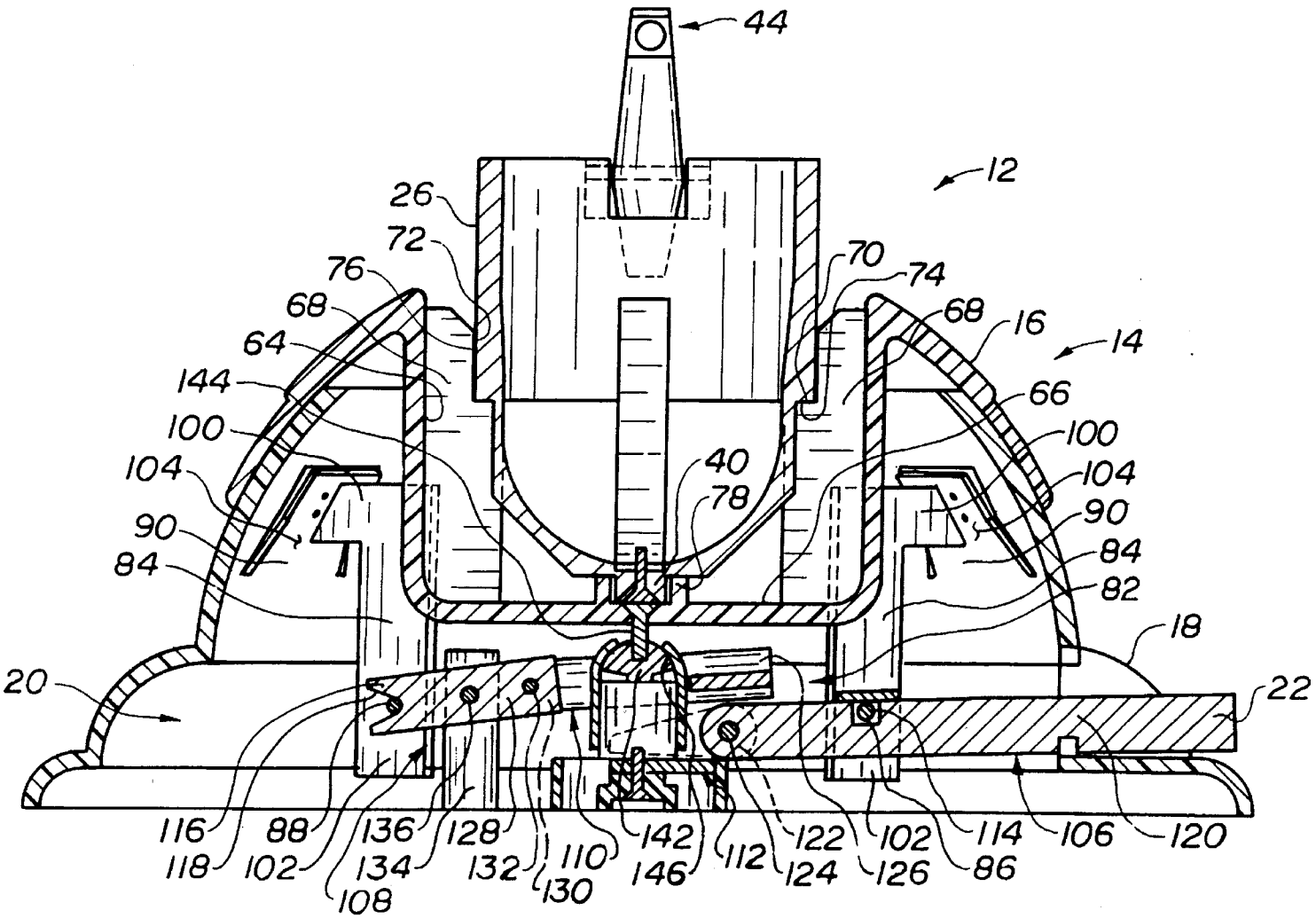
FIG. 6 is a cross-sectional side view of the receptacle inserted into the base of the Christmas tree stand of FIG. 1.

An exploded cross-sectional side view of the receptacle 12 in relationship to the base 14 of the Christmas tree stand 10 and a cross-sectional side view of the receptacle 12 inserted into the base 14 are illustrated in FIGS. 5*a*, 5*b* and 6, respectively. These views illustrate the mating engagement of the respective configurations of the receiving wall surface 64 and the receiving floor surface 66 and the receptacle 12.

As illustrated, the receiving wall surface 64 has a plurality of fins 68 which are circumferentially spaced around the receiving wall surface 64. The fins 68 extend inwardly into the cavity 24. When the receptacle 12 is inserted into the cavity 24, the U-shaped members 28 of the receptacle 12 are interposed between and in mating engagement with adjacent fins 68. The width of the U-shaped members 28 corresponds to the spacing between adjacent fins 68 to ensure mating engagement between the U-shaped members 28 and the adjacent fins 68. In this manner, circumferential movement of the receptacle 12 within the cavity 24 is prevented. Additionally, equivalent spacing is provided between adjacent fins 68 to allow the receptacle 12 to be inserted into the cavity 24 in any position. Each fin 68 has an upwardly facing flange 70 and an inwardly facing surface 72 which abut a bottom edge 74 and an outer lower portion 76, respectively, of the sleeve 26 of the receptacle 12 when the receptacle 12 is inserted into the cavity 24. This configuration of the fins 68 helps to prevent movement of the receptacle 12 within the cavity 24.

As also illustrated in FIGS. 5*a*, 5*b* and 6, the receiving floor surface 66 has a circular ridge 78. The circular ridge 78 forms a depression 80 within which the circular projection 40 is engaged during use of the Christmas tree stand 10. When the receptacle 12 is inserted into the cavity 24, the circular projection 40 is inserted into the depression 80 formed by the circular ridge 78. In this manner, movement of the receptacle 12 within the cavity 24 is further prevented.

The components of the movement assembly 20 and operation of the movement assembly 20 which enables the top portion 16 of the base 14 to move with respect to the bottom portion 18 of the base 14 are illustrated in FIGS. 5*a*, 5*b*–12. The movement assembly 20 includes the following interconnected components: a lever assembly 82 (which includes the foot pedal 22), a plurality of inverted L-shaped members 84, a first rod 86, and a second rod 88.

Figure 7:
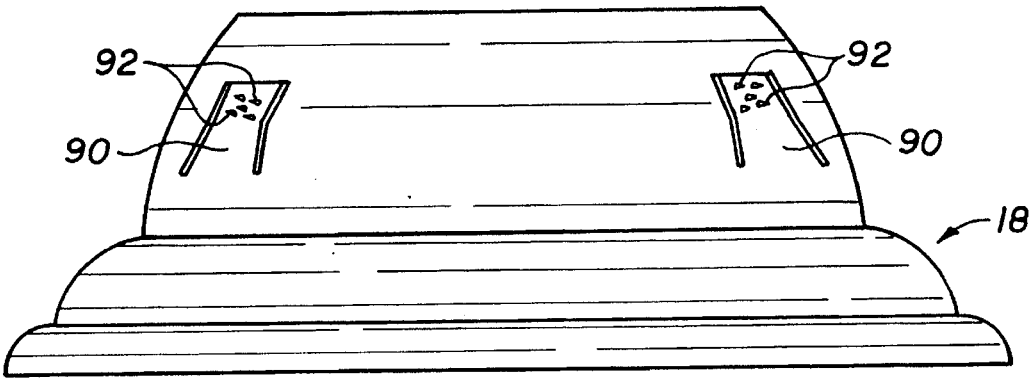
FIG. 7 is a side view of the bottom portion of the base of the Christmas tree stand of FIG. 1.
Figure 10:
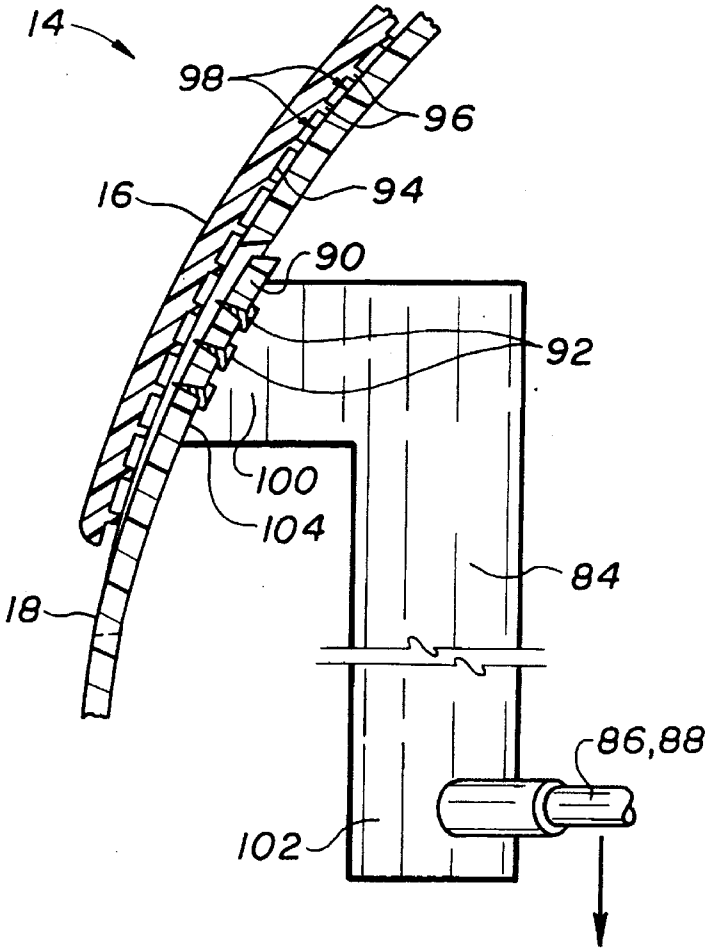
FIG. 10 is a partial cross-sectional side view of the base of the Christmas tree stand of FIG. 1 illustrating the tabs moved inwardly from the bottom portion.
Figure 9:
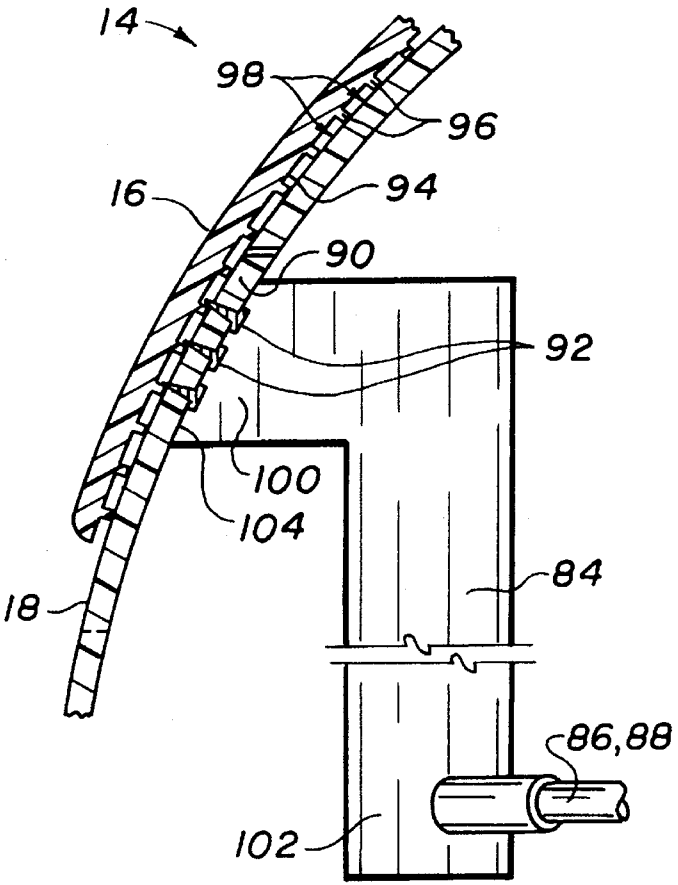
FIG. 9 is a partial cross-sectional side view of the base of the Christmas tree stand of FIG. 1 illustrating the tabs in alignment with the bottom portion.

The movement assembly 20 is interconnected with tabs 90 which, in the preferred embodiment, are integral with the bottom portion 18, as illustrated in FIG. 7. Further, in the preferred and illustrated embodiment, the tabs 90 are circumferentially spaced around the bottom portion 18 at approximately 90° intervals. The tabs 90 have protrusions 92 thereon which project outwardly toward the top portion 16. As illustrated in FIGS. 9 and 10, an inner surface 94 of the top portion 16 has a plurality of radially spaced, concentric, circumferential ridges 96. The ridges 96 form a plurality of adjacent valleys 98 intermediate the ridges 96 in the inner surface 94 of the top portion 16.

Figure 8:
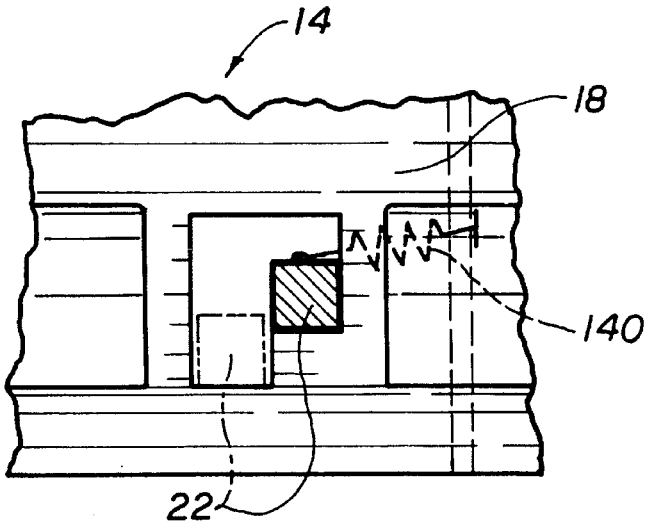
FIG. 8 is a partial view of the base of the Christmas tree stand of FIG. 1 illustrating the two positions of the foot pedal.

As previously stated and as illustrated in FIG. 8, the foot pedal 22 may be moved between a first position and a second position. When the foot pedal 22 is in the first position (illustrated in solid lines in FIG. 8), the tabs 90 are in alignment with the bottom portion 18 (as illustrated in FIG. 9) and the protrusions 92 project outwardly from the bottom portion 18 into the valleys 98 in the top portion 16. In this first position, the protrusions 92 engage with the ridges 96 in the top portion 16 and the top portion 16 is thus prevented from moving with respect to the bottom portion 18.

When the foot pedal 22 is in the second position (illustrated in phantom in FIG. 8), the tabs 90 having the protrusions 92 thereon are moved inwardly (as illustrated in FIG. 10) causing the protrusions 92 to be moved away from and out of engagement with the ridges 96 and the valleys 98 in the top portion 16, and the top portion 16 is thus permitted to move freely with respect to the bottom portion 18. In this second position, the Christmas tree C, secured within the receptacle 12, may be easily adjusted to a desired vertical position by moving the top portion 16 and the receptacle 12 with respect to the bottom portion 18.

FIGS. 5*a*, 5*b*, 6, 11, and 12 further illustrate the operation of the movement assembly 20 which enables the top portion 16 of the base 14 to move with respect to the bottom portion 18 of the base 14. One of the inverted L-shaped members 84 is associated with each of the tabs 90 in the bottom portion 18. Each L-shaped member 84 has a first end 100 and a second end 102. The first end 100 of each L-shaped member 84 is connected to an inner surface 104 of the corresponding tab 90. The second end 102 of each L-shaped member 84 is connected to a rod. In the preferred and illustrated embodiment, the first rod 86 and the second rod 88 interconnect the L-shaped members 84.

The lever assembly 82 extends through the bottom portion 18 of the base 14 and within the bottom portion 18. The lever assembly 82 includes a first lever portion 106, a second lever portion 108, and a pivoting portion 110 which interconnects the first lever portion 106 and the second lever portion 108. The lever assembly 82 further includes a support portion 112. The first lever portion 106 has a bore 114 therein for receiving the first rod 86. An outer end 116 of the second lever portion 108 has a groove 118 therein for receiving the second rod 88. An outer end 120 of the first lever portion 106 is connected to the foot pedal 22. An inner end 122 of the first lever portion 106 is connected to the support portion 112 by means of a first pivot pin 124, and is further connected to a first end 126 of the pivoting portion 110. An inner end 128 of the second lever portion 108 is connected to a second end 130 of the pivoting portion 110 by means of a second pivot pin 132. Restraining blocks 134 are located on each side of the second lever portion 108 and are connected thereto by means of a restraining pin 136. Further, pegs 138 are located in the second rod 88 on each side of the second lever portion 108. Both the restraining blocks 134 and the pegs 138 prevent movement of the second lever portion 108 out of its operating position.

Figure 11:
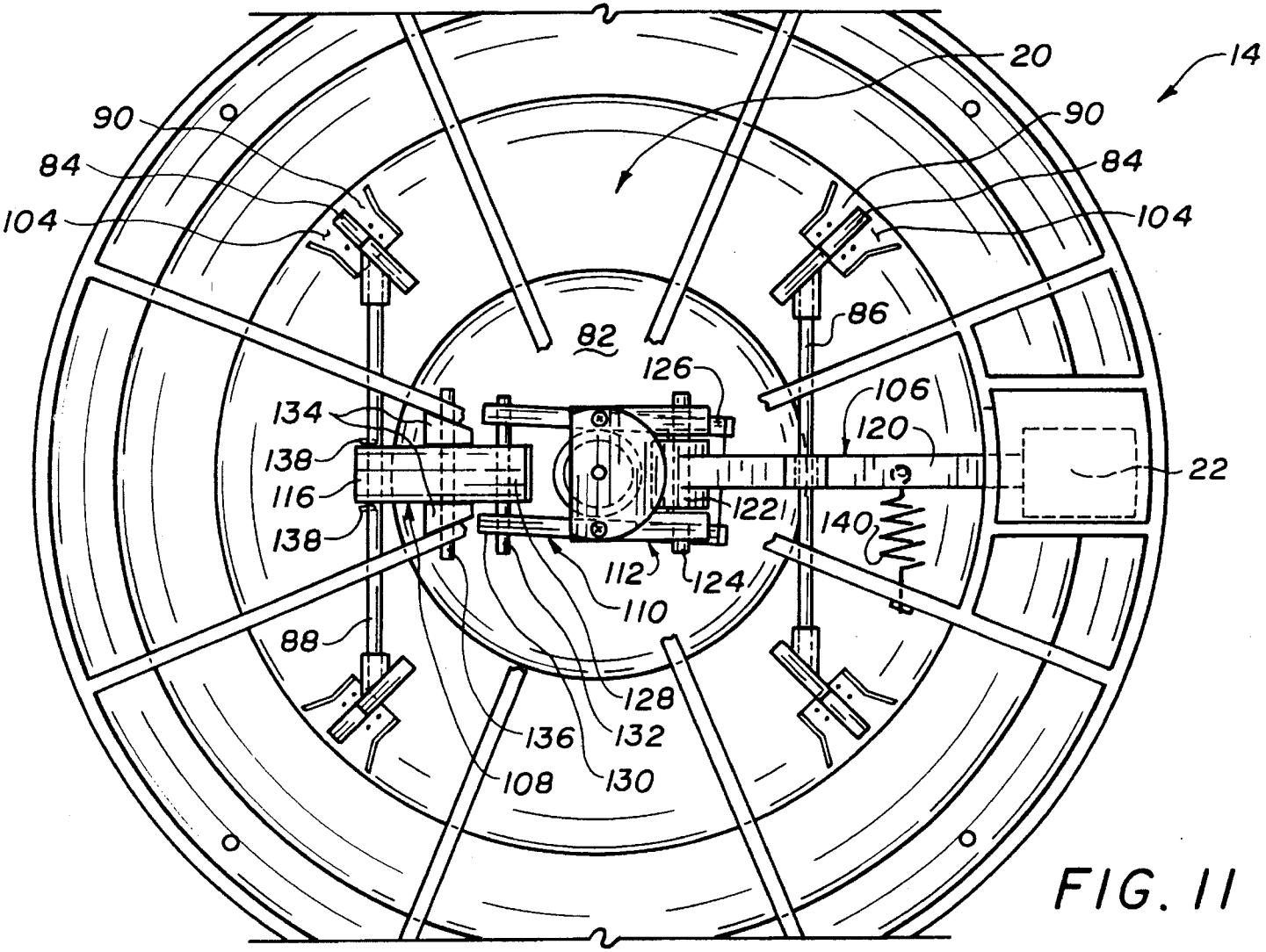
FIG. 11 is a bottom view of the base of the Christmas tree stand of FIG. 1 illustrating the arrangement of the movement assembly when the foot pedal is in the first position.
Figure 12:
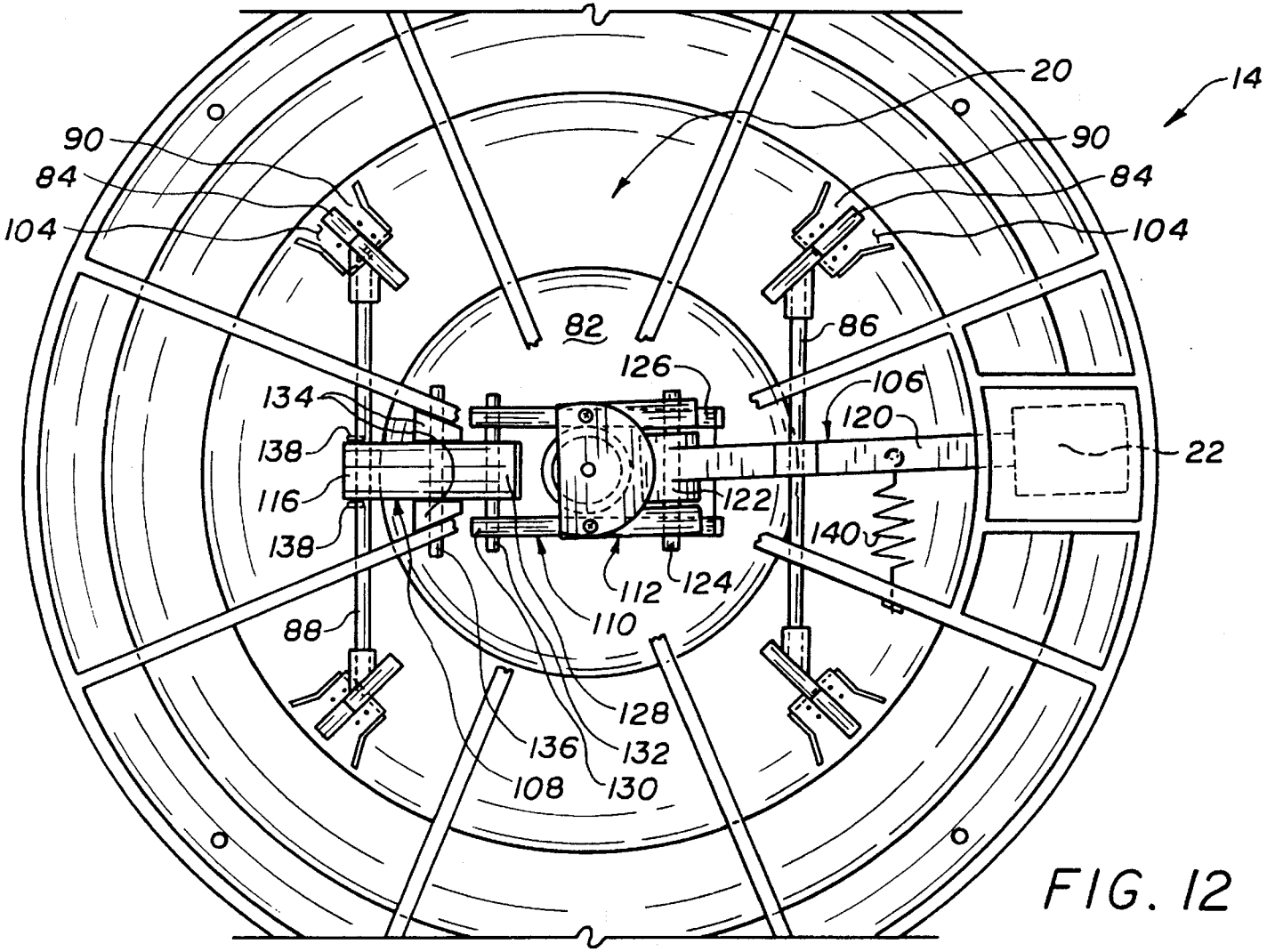
FIG. 12 is a bottom view of the base of the Christmas tree stand of FIG. 1 illustrating the arrangement of the movement assembly when the foot pedal is in the second position.

When the foot pedal 22 is in the first position, the movement assembly 20 is arranged as illustrated in FIGS. 5*a*, 5*b* and 11. When the foot pedal 22 is moved to the second position (i.e., moved to the left and downwardly), the movement assembly 20 is moved to the arrangement illustrated in FIGS. 6 and 12. Specifically, when the foot pedal 22 is moved downwardly, the following chain of events occurs:

(i) the outer end 120 of the first lever portion 106, which is connected to the foot pedal 22, moves downwardly in response to the foot pedal 22 movement;

(ii) the inner end 122 of the first lever portion 106 pivots at the first pivot pin 124 in response to the outer end 120 movement;

(iii) the first end 126 of the pivoting portion 110, which is connected to the inner end 122 of the first lever portion 106, moves downwardly in response to the inner end 122 movement;

(iv) the second end 130 of the pivoting portion 110 moves upwardly in response to the first end 126 movement;

(v) the inner end 128 of the second lever portion 108, which is connected to the second end 130 of the pivoting portion 110 by means of the second pivot pin 132, pivots at the second pivot pin 132 and moves upwardly in response to the second end 130 movement; and (vi) the outer end 116 of the second lever portion 108 moves downwardly in response to the inner end 128 movement.

When the outer end 120 of the first lever portion 106 moves downwardly, the first rod 86 and the L-shaped members 84 connected thereto are pulled downwardly. Similarly, when the outer end 116 of the second lever portion 108 moves downwardly, the second rod 88 and the L-shaped members 84 connected thereto are pulled downwardly. As a result, the tabs 90 having the protrusions 92 thereon are moved inwardly causing the protrusions 92 to be moved away from and out of engagement with the ridges 96 and the valleys 98 in the top portion 16 of the base 14. Thus, the top portion 16 is permitted to move freely with respect to the bottom portion 18. In this position, one person, having one foot on the foot pedal 22 and one hand on the Christmas tree C, may easily adjust the vertical position of the Christmas tree C secured within the receptacle 12 while standing in an upright position where the desired vertical position of the Christmas tree C is readily apparent. When the desired vertical position is obtained by simply moving the Christmas tree C, the foot pedal 22 is released.

When the foot pedal 22 is released, it returns to the first position and the above chain of events reverses itself. A spring 140, which interconnects the first lever portion 106 with the bottom portion 18 of the base 14, ensures that the first lever portion 106, and thus the entire lever assembly 82, returns to its original position. As a result, the tabs 90 are moved to their original positions in alignment with the bottom portion 18 and the protrusions 92 project outwardly from the bottom portion 18 into the valleys 98 in the top portion 16 causing the protrusions 92 to engage with the ridges 96 in the top portion 16. Thus, the top portion 16 is prevented from moving with respect to the bottom portion 18, and the Christmas tree C secured within the receptacle 12 is maintained in the desired vertical position.

Further, as illustrated in FIGS. 5*a*, 5*b* and 6, the top portion 16 of the base 14 is connected to a ball-like member 142 via a fastener or screw 144. The ball-like member 142 is rotatable within a mating socket member 146 which is connected to the bottom portion 18 of the base 14. Rotation of the ball-like member 142 within the socket member 146 permits the top portion 16 to move with respect to the bottom portion 18 when the foot pedal 22 is in the second position.

Figure 13:
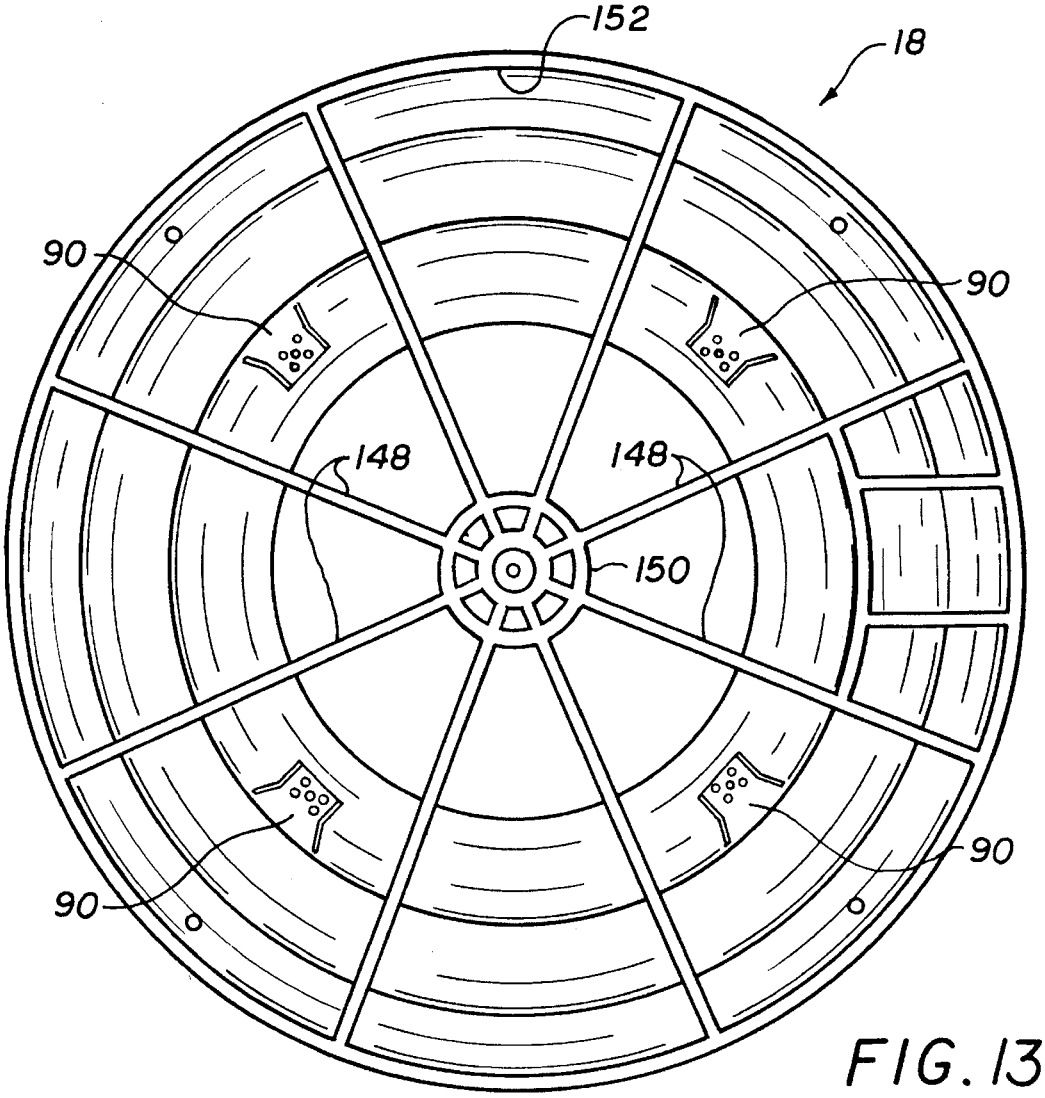
FIG. 13 is a bottom view of the bottom portion of the base of the Christmas tree stand of FIG. 1.
Figure 14:
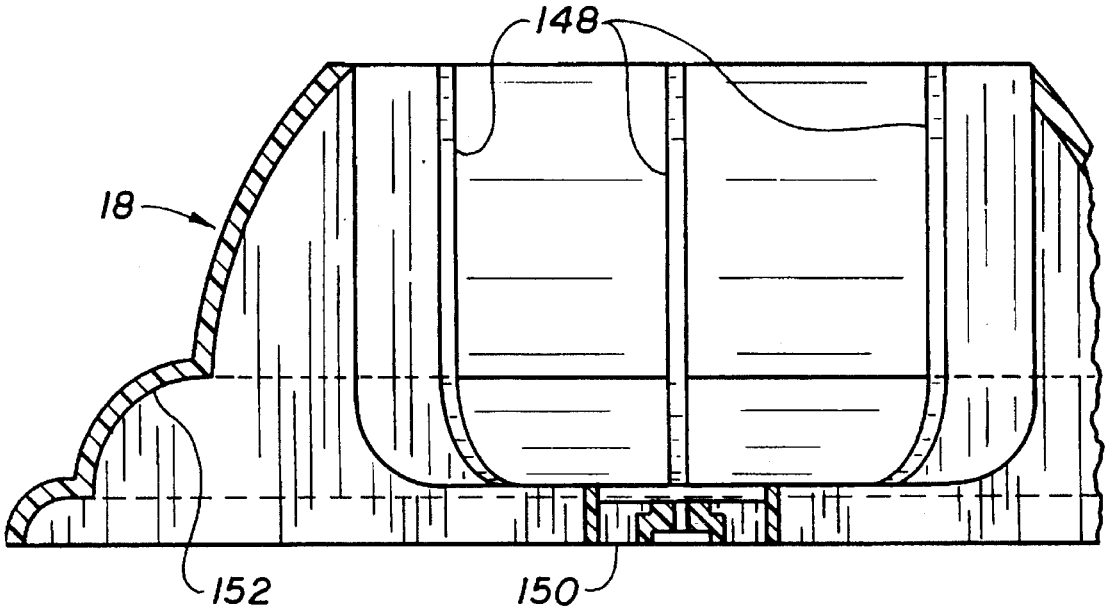
FIG. 14 is a cross-sectional side view of the bottom portion of the base of the Christmas tree stand of FIG. 1.

Referring now to FIGS. 13 and 14, the internal support structure of the base 14 is illustrated having a plurality of ribs 148 radially extending from a central hub 150. Each of the ribs 148 extends from the central hub 150 to an inner surface 152 of the bottom portion 18 of the base 14. Further, each of the ribs 148 extends along the entire vertical length of the inner surface 152.

One may now appreciate that the present invention provides a Christmas tree stand which permits a Christmas tree to be solidly secured within the stand and to be easily adjusted to a desired vertical position.

Although the present invention has been illustrated and described with respect to a certain preferred embodiment, it is obvious that equivalent alterations and modifications will occur to others skilled in the art upon the reading and understanding of this specification. The present invention includes all such equivalent alterations and modifications and is limited only by the scope of the following claims.

What is claimed is:

1. A tree stand for positioning a tree, said stand comprising:

a receptacle for receiving a trunk of a tree;

a clamping assembly connected to said receptacle for securing a trunk of a tree within said receptacle;

a base for supporting said receptacle and a tree, said base including:

a top portion for receiving said receptacle; and a bottom portion for supporting said top portion; and a movement assembly which enables said top portion of said base to move with respect to said bottom portion of said base to position a tree;

wherein said clamping assembly comprises a plurality of arms, each of said arms being attached to said receptacle between a first end and a second end, each of said second ends having a point thereon for engagement into a trunk of the tree upon movement of said second ends toward the trunk to secure the trunk of the tree within said receptacle;

wherein said arms extend above said receptacle to engage said points on said second ends into the trunk of the tree spaced above said receptacle; and wherein each of said first ends includes a movable fastener secured thereto for engagement with an outer portion of said sleeve, and movement of said fasteners in said first ends moves said points on said second ends into engagement with the trunk of the tree.

2. A tree stand for positioning a tree, said stand comprising:

a receptacle for receiving a trunk of a tree, said receptacle including a U-shaped member extending downwardly from the remainder of said receptacle;

a clamping assembly connected to said receptacle for securing a trunk of a tree within said receptacle;

a base for supporting said receptacle and a tree, said base including:

a top portion for receiving said receptacle; and a bottom portion for supporting said top portion; and a movement assembly which enables said top portion of said base to move with respect to said bottom portion of said base to vertically position a tree;

wherein said top portion of said base has a cavity for receiving said receptacle;

wherein said receptacle and a receiving surface of said top portion defining said cavity are configured for mating engagement to engage said receptacle with said top portion of said base; and wherein said receiving surface defining said cavity has a plurality of fins which are circumferentially spaced around said receiving surface and extend inwardly into said cavity, and said U-shaped member is interposed between and in mating engagement with adjacent fins.

3. A tree stand for positioning a tree, said stand comprising:

a receptacle for receiving a trunk of a tree;

a clamping assembly connected to said receptacle for securing a trunk of a tree within said receptacle;

a base for supporting said receptacle and a tree, said base including:

a top portion for receiving said receptacle; and a bottom portion for supporting said top portion; and a movement assembly which enables said top portion of said base to move with respect to said bottom portion of said base to vertically position a tree;

wherein said bottom portion of said base has a plurality of protrusions which project outwardly from said bottom portion toward said top portion of said base to prevent movement of said top portion with respect to said bottom portion, and which are movable away from said top portion of said base to permit movement of said top portion with respect to said bottom portion.

4. The tree stand as set forth in claim 3, wherein an inner surface of said top portion has a plurality of radially spaced, concentric, circumferential ridges, said plurality of ridges forming a plurality of valleys in said inner surface of said top portion, said protrusions engaging with said ridges and said valleys in said top portion to prevent movement of said top portion with respect to said bottom portion.

5. The tree stand as set forth in claim 3, wherein said bottom portion of said base has a plurality of integral tabs, said tabs having said plurality of protrusions projecting outwardly from said bottom portion toward said top portion thereon, said plurality of tabs being movable away from said top portion of said base to move said plurality of protrusions away from said top portion of said base.

6. A tree stand for positioning a tree, said stand comprising:

a receptacle for receiving a trunk of a tree;

a clamping assembly connected to said receptacle for securing a trunk of a tree within said receptacle;

a base for supporting said receptacle and a tree, said base including:

a top portion for receiving said receptacle; and a bottom portion for supporting said top portion; and a movement assembly which enables said top portion of said base to move with respect to said bottom portion of said base to vertically position a tree;

wherein said movement assembly includes a foot pedal for enabling engagement and disengagement of said top portion and said bottom portion of said base.

7. The tree stand as set forth in claim 6, wherein said foot pedal is moveable between a first position for adjusting a vertical position of the tree secured within said receptacle and a second position for maintaining the tree secured within said receptacle in a desired vertical position.

8. The tree stand as set forth in claim 7, wherein said top portion of said base may move freely with respect to said bottom portion of said base when said foot pedal is in said first position, and wherein said top portion of said base is fixed with respect to said bottom portion of said base when said foot pedal is in said second position.

9. A tree stand for positioning a tree, said stand comprising:

a receptacle for receiving a trunk of a tree;

a clamping assembly connected to said receptacle for securing a trunk of a tree within said receptacle;

a base for supporting said receptacle and a tree, said base including:

a top portion for receiving said receptacle; and a bottom portion for supporting said top portion; and a movement assembly which enables said top portion of said base to move with respect to said bottom portion of said base to vertically position a tree;

said movement assembly including a foot pedal for enabling engagement and disengagement of said top portion and said bottom portion of said base;

wherein said foot pedal is moveable between a first position for adjusting a vertical position of a tree secured within said receptacle and a second position for maintaining a tree secured within said receptacle in a desired vertical position;

wherein said top portion of said base may move freely with respect to said bottom portion of said base when said foot pedal is in said first position, and wherein said top portion of said base is fixed with respect to said bottom portion of said base when said foot pedal is in said second position.

* * * * *

UNITED STATES PATENT AND TRADEMARK OFFICE

CERTIFICATE OF CORRECTION

PATENT NO. : 5,507,117

DATED : April 16, 1996

INVENTOR(S) : KALMAN, et al.

It is certified that error appears in the above-identified patent and that said Letters Patent is hereby corrected as shown below:

On the title page, item [73] should read

-- County Line Limited, L.L.C. --

Signed and Sealed this

Fifteenth Day of December, 1998

Bruce Lehman

*Attest:*

BRUCE LEHMAN

*Attesting Officer*

*Commissioner of Patents and Trademarks*